US007815753B2

(12) United States Patent
Yi et al.

(10) Patent No.: US 7,815,753 B2
(45) Date of Patent: Oct. 19, 2010

(54) FE-BASED BULK AMORPHOUS ALLOY COMPOSITIONS CONTAINING MORE THAN 5 ELEMENTS AND COMPOSITES CONTAINING THE AMORPHOUS PHASE

(75) Inventors: Seong-Hoon Yi, Daegu (KR); Hong-Xiang Li, Daegu (KR); Myung-Il Heo, Daegu (KR); Jong-Chul Yi, Daegu (KR); Dong-Jin Yu, Daegu (KR); Sang-Hum Kwon, Daegu (KR); Chul-Woo Kim, Jinju-si (KR); Jong-Won Kim, Busan (KR); In-Seok Hwang, Ulsan (KR)

(73) Assignee: Kyungpook National University Industry-Academic Cooperation Foundation (KR)

( * ) Notice: Subject to any disclaimer, the term of this patent is extended or adjusted under 35 U.S.C. 154(b) by 396 days.

(21) Appl. No.: 11/719,871

(22) PCT Filed: Aug. 11, 2005

(86) PCT No.: PCT/KR2005/002603

§ 371 (c)(1),
(2), (4) Date: May 22, 2007

(87) PCT Pub. No.: WO2006/054822

PCT Pub. Date: May 26, 2006

(65) Prior Publication Data

US 2007/0295429 A1 Dec. 27, 2007

(30) Foreign Application Priority Data

Nov. 22, 2004 (KR) ..... 10-2004-0095976

(51) Int. Cl.
*C22C 45/02* (2006.01)

(52) U.S. Cl. ..... 148/304; 148/403

(58) Field of Classification Search ..... None
See application file for complete search history.

(56) References Cited

U.S. PATENT DOCUMENTS 5,288,344 A 2/1994 Peker et al.

(Continued)

FOREIGN PATENT DOCUMENTS

JP 1982185957 5/1981

(Continued)

OTHER PUBLICATIONS

English Translation of JP 2004-156134.*

(Continued)

*Primary Examiner*—George Wyszomierski
(74) *Attorney, Agent, or Firm*—Cantor Colburn LLP

(57) ABSTRACT

Disclosed is a Fe-based bulk amorphous alloy composition which forms a bulk amorphous substance due to its excellent amorphous formability when it is cooled to a temperature lower than its glass transition temperature from the liquid state at a relatively low cooling rate of 1000 K/s or less, has high warm processability in a low temperature range owing to its supercooled liquid region of 20K or higher and has excellent fluidity in the liquid state and thereby good castability. The Fe-based multi-element bulk amorphous alloy composition is represented by a formula of $Fe_{\alpha}C_{\beta}Si_{\gamma}B_{x}P_{y}M_{a}$, in which M is at least one element selected from Ti(titanium), Cr(chromium), Mo(molybdenum), Nb(niobium), Zr(Zirconium), Ta(tantalum), W(tungsten) and V(vanadium), α, β, γ, x, y, and a each represent atomic % of iron(Fe), Carbon(C), silicon(Si), boron(B), phosphorus(P) and the selected metal element, in which α is 100-(β+γ+x+y+a) atomic %, β is 6 atomic % or more and 13 atomic % or less, γ is 1 atomic % or more and 5 atomic % or less, x is 4.5 atomic % or more and 9.5 atomic % or less, y is 3 atomic % or more and 10 atomic % or less and a is 0.1 atomic % or more and 6 atomic % or less.

5 Claims, 4 Drawing Sheets

U.S. PATENT DOCUMENTS

| | | | | |
|---|---|---|---|---|
| 5,735,975 | A | 4/1998 | Lin et al. | |
| 5,876,519 | A * | 3/1999 | Inoue et al. | 148/304 |
| 6,053,989 | A | 4/2000 | Orillion et al. | |
| 6,077,367 | A * | 6/2000 | Mizushima et al. | 148/561 |
| 6,325,868 | B1 | 12/2001 | Kim et al. | |
| 2003/0201032 | A1* | 10/2003 | Yoshida et al. | 148/121 |
| 2005/0236071 | A1* | 10/2005 | Koshiba et al. | 148/304 |

FOREIGN PATENT DOCUMENTS

| | | |
|---|---|---|
| JP | 1988117406 | 11/1986 |
| JP | 1994158239 | 11/1992 |
| JP | 1996333660 | 12/1996 |
| JP | 19977256122 | 9/1997 |
| JP | 2004156134 | 6/2004 |

OTHER PUBLICATIONS

Fe-based bulk metallic glasses with diameter thickness larger than one centimeter; V. Ponnambalam, S. Joseph Poon, Gary J. Shiflet; J. Mater. Res., vol. 19, No. 5, May 2004; 2004 Materials Research Society.

Bulk Amorphous Ni75-xNb5MxP20-yBy (M=Cr,Mo) Alloys with Large Supercooling and High Strength; Xinmin Wang, Isamu Yoshii, Akihisa Inoue, Yon-Han Kim, In-Bae Kim; Materials Transactions Kim, Vol. 40, No. 10 (1999) , pp. 1130 to 1136.

Ni-based bulk metallic glass formation in the Ni-Nb-Sn and Ni-Nb-Sn-X (X=B,Fe,Cu) alloy systems; Haein Choi-Yim, Donghua Xu, William L. Johnson; Applied Physics Letters vol. 82, No. 7; Feb. 17, 2003; pp. 1030-1032 .

International Search Report, dated Dec. 9, 2005. All references cited in the Search Report and not previously submitted are listed above.

* cited by examiner

[Fig. 1]
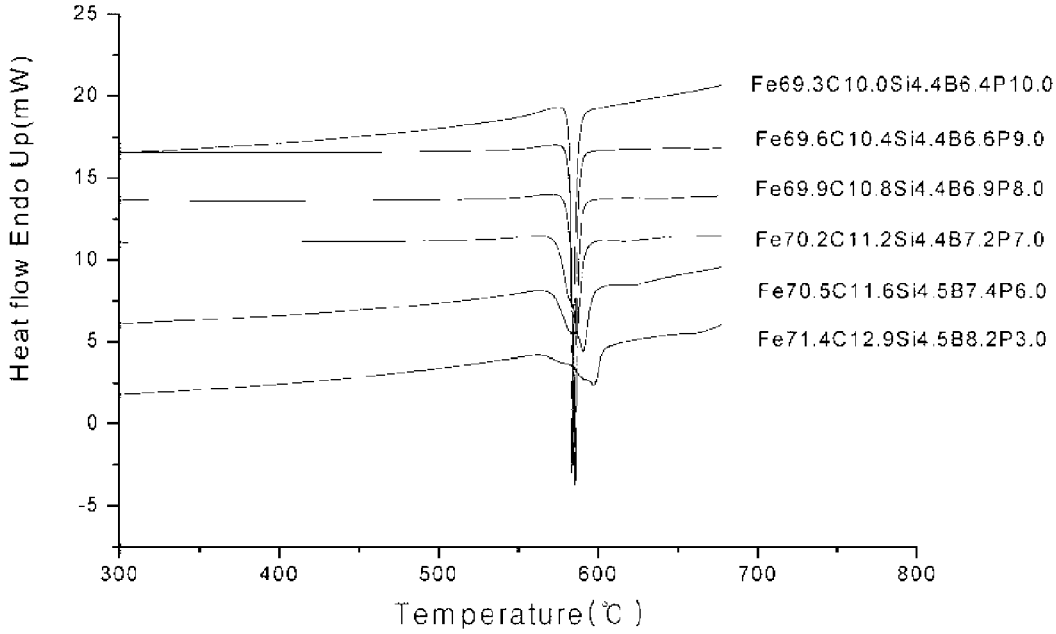
[Fig. 2]
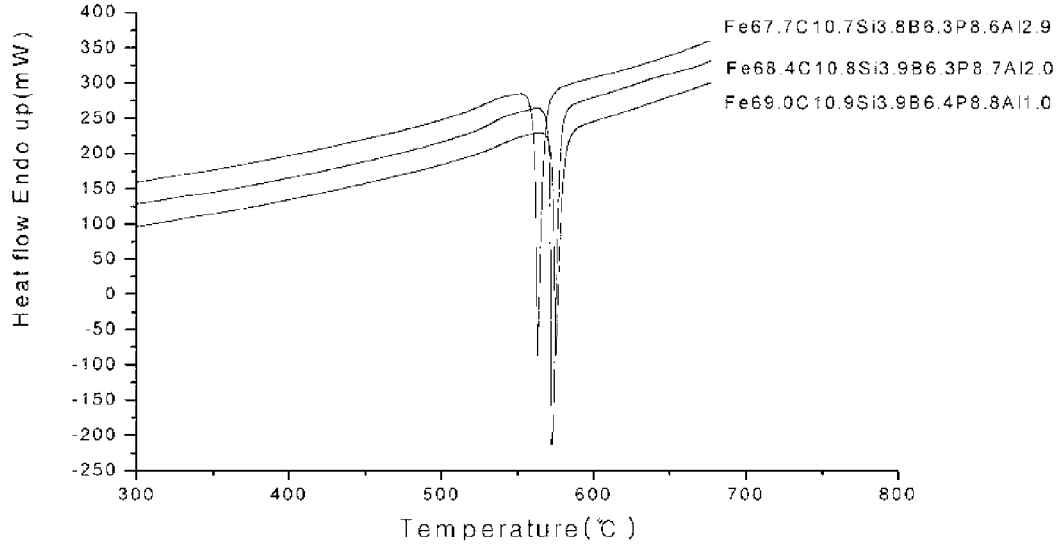

[Fig. 3]
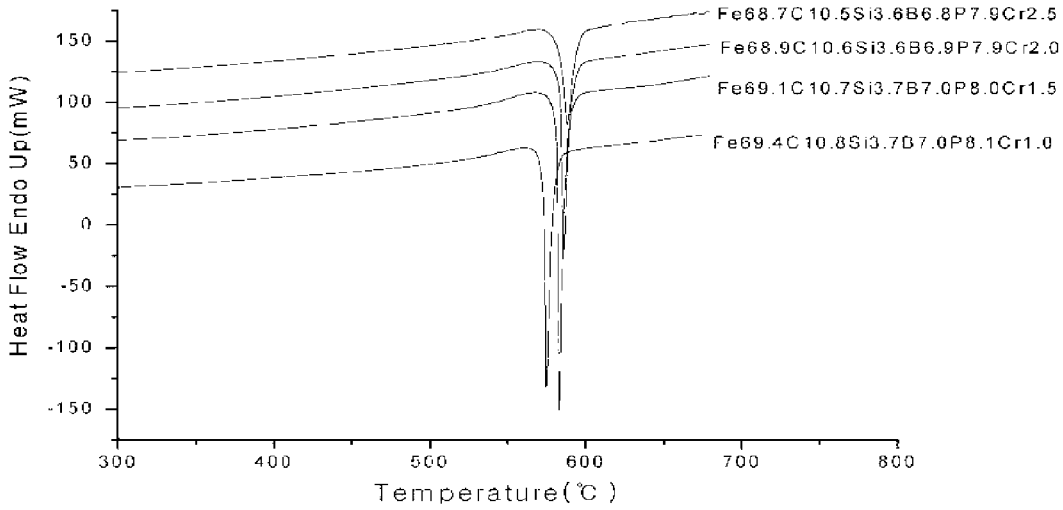
[Fig. 4]
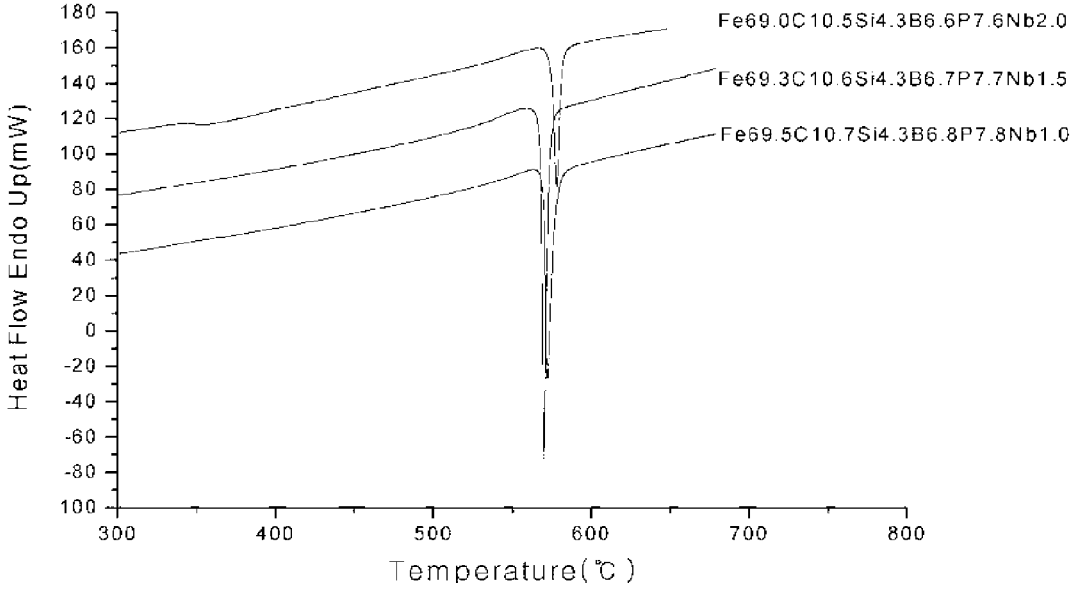

[Fig. 5]
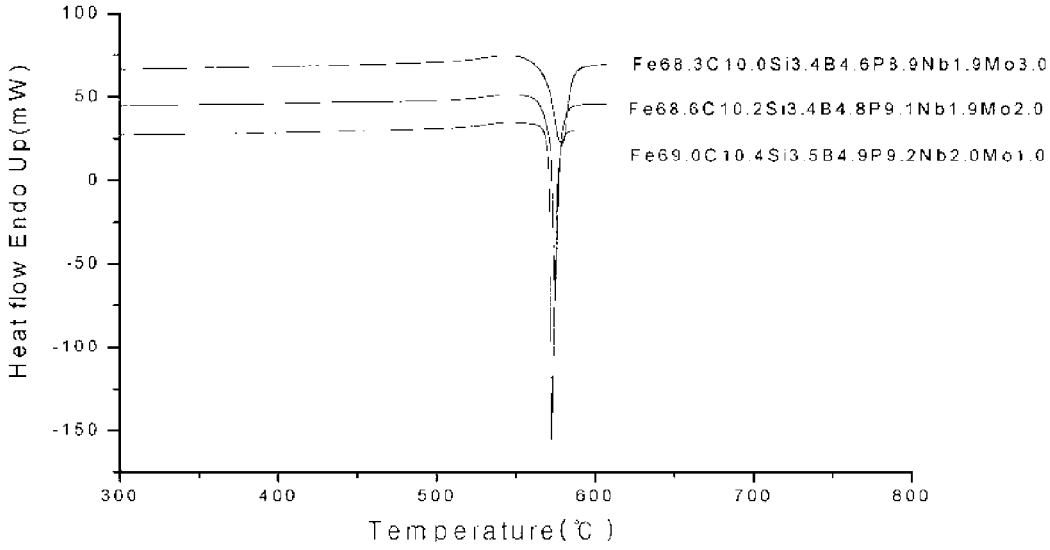
[Fig. 6]
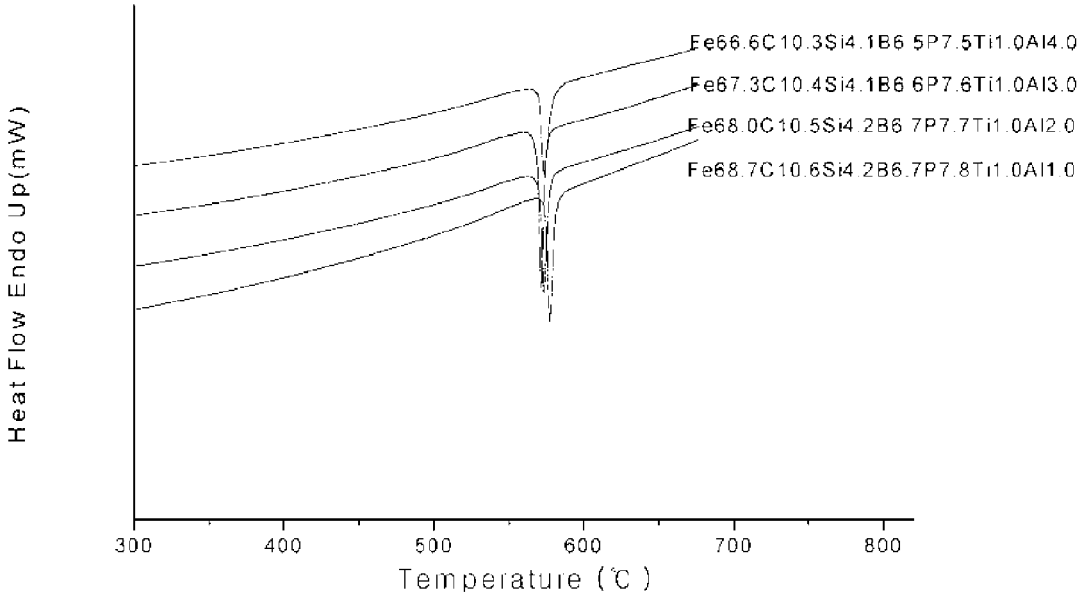

[Fig. 7]
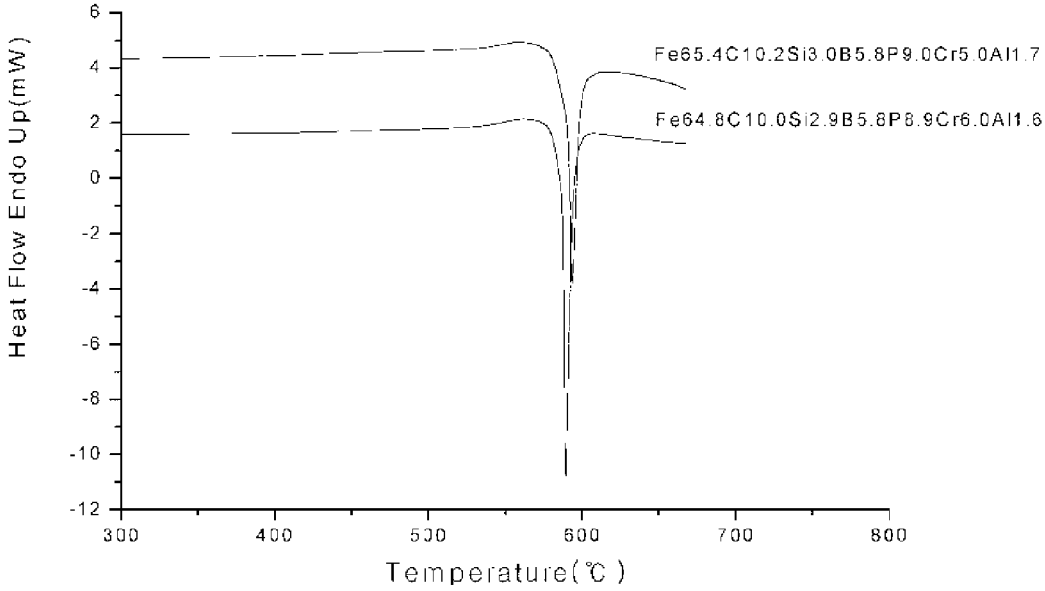

FE-BASED BULK AMORPHOUS ALLOY COMPOSITIONS CONTAINING MORE THAN 5 ELEMENTS AND COMPOSITES CONTAINING THE AMORPHOUS PHASE

TECHNICAL FIELD

The present invention relates to a Fe-based bulk amorphous alloy composition. More particularly, it relates to a Fe-based bulk amorphous alloy composition which forms a bulk amorphous substance due to its excellent amorphous formability when it is cooled to a temperature lower than its glass transition temperature from the liquid state at a relatively low cooling rate of 1000 K/s or less, has high warm processability in a low temperature range owing to its supercooled liquid region of 20K or higher and has excellent fluidity in the liquid state and thereby good castability.

BACKGROUND ART

Most metal alloys forms crystals with systematic atom arrangement upon solidification from the liquid phase. However, if the cooling rate is large enough over the critical value and thereby, nuclear formation of the crystal phase is suppressed, unsystematic atom structure in the liquid phase can be maintained. An alloy having such structure is called an amorphous alloy, and an alloy particularly containing metal atoms is called metallic glass alloy.

Since the first report of a metallic glass phase in an Au—Si alloy in 1960, many kinds of amorphous alloy have been proposed and used. However, most amorphous alloys are only prepared in the form of ribbons having a thickness of about 80 μm or less, micro wires having a diameter of about 150 μm or less or powder having a particle size of several hundreds gm or less using the rapid quenching method with a high cooling rate of $10^4$ to $10^6$ K/s.

Therefore, since there is a limit in shape and size in the preparation of the amorphous alloys by the rapid quenching method, the amorphous alloys cannot be used for industrial application as a structural material but a part of them can be used for industrial application as a functional material such as magnetic materials.

Thus, in order to meet the need for application as a advanced-functional/structural metal material, it is desired to have an alloy composition which has excellent glass forming ability and can form amorphous phase at a low critical cooling rate and can be cast with a bulk amorphous material.

By U.S. Pat. Nos. 5,288,344 and 5,735,975, it is known that amorphous alloys having a critical cooling rate of about several K/s and a very wide supercooled liquid region can be formed in a predetermined shape for use as a structural material. The Zr—Ti—Cu—Ni—Be alloy and the Zr—Ti—Al—Ni—Cu alloy are already used as bulk amorphous products. In addition, novel bulk amorphous alloys are developed from various alloys such as nickel-based, titanium-based or copper-based alloys and evaluated to have useful and characteristic properties such as excellent corrosion resistance and strength. For example, according to Materials Transactions (JIM, Vol. 40 (10), pp. 1130-1136), a bulk amorphous alloy having a maximum diameter of 1 mm is prepared from Ni—Nb—Cr—Mo—P—B by copper mold casting. This bulk amorphous alloy has a relatively wide supercooled liquid region.

Also, U.S. Pat. No. 6,325,868 discloses a bulk amorphous alloy having a maximum diameter of 3 mm based on Ni—Zr—Ti—Si—Sn by copper mold casting. This bulk amorphous alloy also has a relatively wide supercooled liquid region.

Further, according to Applied Physics letters (Vol. 82, No. 7, pp. 1030-1032), a bulk amorphous alloy having a maximum diameter of 3 mm is prepared from Ni—Nb—Sn by copper mold casting.

Meanwhile, Fe-based amorphous alloys have been used usually as a magnetic material for several tens years. Recently, alloys that can be cast to a size of several mm or more have been developed and actively studied for their application as advanced-functional structural material. For example, Professor Poon et al. in the University of Virginia have reported that an amorphous rod having a size of 12 mm can be prepared from an alloy based on Fe—Cr—Mo—(Y, Ln)—C—B (Journal of Materials Research Vol. 19 No. 5, pp. 1320-1323).

However, those bulk amorphous alloys developed in the prior art have problems in terms of industrial application, as follows.

Firstly, since the glass forming ability of the alloys is greatly affected by an impurity content in raw materials of the alloys, expensive high purity materials should be used and the material processing upon dissolution and casting should be precisely performed under a special atmosphere such as vacuum or Ar (argon) gas atmosphere.

Secondly, since most alloys contain rare metals such as Er (erbium), Y (yttrium) and the like or a large amount of expensive atoms such as Mo (molybdenum) and Cr (chromium), there is a problems related with increase in the production cost including unit cost of raw materials and additional cost caused by dissolution and use of a special furnace.

Thirdly, the conventional bulk amorphous alloys have much higher viscosities in the liquid phase, as compared to general metals and thus, poor castability, which presents a limit in the casting and product design. Therefore, though the conventional bulk amorphous alloys have very unique and beneficial properties, they can be prepared only experimentally and have problems related with the production cost and difficulties in application of the process for mass-production using existing equipments.

Therefore, it is desired to have a Fe-based amorphous alloy composition which has excellent castability and can be prepared by economical raw materials and process and so that the properties of bulk amorphous alloys can be applied in practical industries.

DISCLOSURE OF THE INVENTION

In order to solve the problems involved in the prior art, it is an object of the present invention to provide a Fe-based multi-element bulk amorphous alloy composition which has high strength and advanced function and is industrially and economically competitive with conventional materials for Fe-based parts in terms of the production process and the production cost. That is, an object of the present invention is to provide a Fe-based multi-element bulk amorphous alloy composition which can produce part materials in common die casting foundries or powder metallurgical works using cast iron or alloy iron produced or used in common iron mills and cast-iron foundries and a comprising the amorphous phase.

It is another object of the present invention to provide a Fe-based multi-element bulk amorphous alloy composition which can produce a bulk amorphous-alloy using alloy--iron which is used in common iron mills since it has a low critical cooling rate and thereby, excellent glass forming ability, and deterioration in the glass phase forming ability caused by impurities is reduced and a comprising the amorphous phase.

It is still another object of the present invention to provide a Fe-based multi-element bulk amorphous alloy composition which has a wide supercooled liquid region and thereby, excellent hot workability, and a low viscosity in the liquid phase and thereby, castability and a comprising the amorphous phase.

That is, the present invention presents a range of alloy composition which can produce a bulk amorphous alloy having excellent properties using cast iron, various alloy iron (Fe—B, Fe—P, Fe—Si, Fe—Mo, Fe—Nb, Fe—V, Fe—Cr and the like) and Al, Ti metals for industrial use as alloy materials. Also, the present invention presents a produced by heat treatment of the amorphous material and a produced by mixing the amorphous material and crystalline material.

The object of the present invention is not limited to the above-described objects. Further objects and advantages of the invention can be clearly understood by a person having ordinarily knowledge in the art from the following detailed description and they are also included in the present invention.

In order to solve the foregoing objects of the present invention, according to an aspect of the present invention, there is provided a Fe-based multi-element bulk amorphous alloy composition represented by a formula of $Fe_{\alpha}C_{\beta}Si_{\gamma}B_{x}P_{y}M_{a}$, in which M is at least one element selected from Ti(titanium), Cr(chromium), Mo(molybdenum), Nb(niobium), Zr(Zirconium), Ta(tantalum), W(tungsten) and V(vanadium), α, β, γ, x, y, and a each represent atomic % of iron(Fe), Carbon(C), silicon(Si), boron(B), phosphorus(P) and the selected metal element, in which α is 100-(β+γ+x+y+a) atomic %, β is 6 atomic % or more and 13 atomic % or less, γ is 1 atomic % or more and 5 atomic % or less, x is 4.5 atomic % or more and 9.5 atomic % or less, y is 3 atomic % or more and 10 atomic % or less and a is 0.1 atomic % or more and 6 atomic % or less.

In a preferred embodiment, M is Ti, β is 9 atomic % or more and 11 atomic % or less, γ is 4 atomic % or more and 5 atomic % or less, x is 6 atomic % or more and 7 atomic % or less, y is 7 atomic % or more and 9 atomic % or less and a is 0.5 atomic % or more and 1.5 atomic % or less.

In another preferred embodiment, M is W or V, β is 9 atomic % or more and 11 atomic % or less, γ is 3 atomic % or more and 5 atomic % or less, x is 6 atomic % or more and 7 atomic % or less, y is 7 atomic % or more and 9 atomic % or less and a is 0.5 atomic % or more and 1.5 atomic % or less.

In a still another preferred embodiment, M is Nb+Mo, β is 9 atomic % or more and 11 atomic % or less, γ is 3 atomic % or more and 5 atomic % or less, x is 4.5 atomic % or more and 6 atomic % or less, y is 8 atomic % or more and 10 atomic % or less and a is 2 atomic % or more and 5 atomic % or less.

In a further preferred embodiment, M is Ti+Cr, β is 9 atomic % or more and 11 atomic % or less, γ is 3 atomic % or more and 5 atomic % or less, x is 6 atomic % or more and 7 atomic % or less, y is 8 atomic % or more and 10 atomic % or less and a is 2 atomic % or more and 5 atomic % or less.

According to another aspect of the present invention, there is provided a Fe-based multi-element bulk amorphous alloy composition represented by a formula of $Fe_{\alpha}C_{\beta}Si_{\gamma}B_{x}P_{y}M_{a}Al_{b}$, in which M is at least one element selected from Ti(titanium), Cr(chromium), Mo(molybdenum), Nb(niobium), Zr(Zirconium), Ta(tantalum), W(tungsten) and V(vanadium), α, β, γ, x, y, a and b each represent atomic % of iron(Fe), Carbon(C), silicon(Si), boron(B), phosphorus(P), the selected metal element and Al(aluminum), in which α is 100-(β+γ+x+y+a+b) atomic %, β is 4 atomic % or more and 13 atomic % or less, γ is 1 atomic % or more and 5 atomic % or less, x is 2 atomic % or more and 9.5 atomic % or less, y is 3 atomic % or more and 10 atomic % or less, a is 0.1 atomic % or more and 10 atomic % or less and b is greater than 0 atomic % and 6 atomic % or less.

In a preferred embodiment of the present invention, M is Cr+Mo, a is 2 atomic % or more and 8 atomic % or less, β is 4 atomic % or more and 8 atomic % or less, γ is 2.5 atomic % or more and 4 atomic % or less, x is 4 atomic % or more and 7 atomic % or less, y is 8 atomic % or more and less than 10 atomic %.

In another preferred embodiment of the present invention, M is Cr, a is 4 atomic % or more and 6 atomic % or less, β is 9 atomic % or more and 11 atomic % or less, γ is 2.5 atomic % or more and 4 atomic % or less, x is 5 atomic % or more and 7 atomic % or less, y is 8 atomic % or more and 9.5 atomic % or less.

In a still another preferred embodiment of the present invention, M is Ti, a is 0.5 atomic % or more and 1.5 atomic % or less, β is 9 atomic % or more and 11 atomic % or less, γ is 3.5 atomic % or more and 4.5 atomic % or less, x is 6 atomic % or more and 7 atomic % or less, y is 7 atomic % or more and 9.5 atomic % or less.

According to a still another aspect of the present invention, there is provided a Fe-based multi-element bulk amorphous alloy composition represented by a formula of $Fe_{\alpha}C_{\beta}Si_{\gamma}B_{x}P_{y}Al_{a}$, in which α, β, γ, x and y each represent atomic % of iron (Fe), Carbon (C), silicon (Si), boron (B) and phosphorus (P), in which α is 100-(β+γ+x+y+a) atomic %, β is 10 atomic % or more and 12 atomic % or less, γ is 3.5 atomic % or more and 4.5 atomic % or less, x is 6 atomic % or more and 8 atomic % or less, y is 8 atomic % or more and 10 atomic % or less and a is 1 atomic % or more and 6 atomic % or less.

According to a further aspect of the present invention, there is provided a Fe-based multi-element bulk amorphous alloy composition represented by a formula of $Fe_{\alpha}C_{\beta}Si_{\gamma}Sn_{x}P_{y}Mo_{a}$, in which α, β, γ, x, y and a each represent atomic % of iron (Fe), Carbon (C), silicon (Si), tin (Sn), phosphorus (P) and molybdenum (Mo), in which α is 100-(β+γ+x+y+a) atomic %, β is 6 atomic % or more and 7 atomic % or less, γ is 1.5 atomic % or more and 2.5 atomic % or less, x is 2.5 atomic % or more and 3.5 atomic % or less, y is 13 atomic % or more and 14 atomic % or less and a is 2 atomic % or more and 3 atomic % or less.

BRIEF DESCRIPTION OF THE DRAWINGS

FIG. 1 is a graph showing the result of a differential thermal analysis of the Fe—C—Si—B—P based alloy.

FIG. 2 is a graph showing the result of a differential thermal analysis of the Fe—C—Si—B—P—Al based alloy.

FIG. 3 is a graph showing the result of a differential thermal analysis of the Fe—C—Si—B—P—Cr based alloy.

FIG. 4 is a graph showing the result of a differential thermal analysis of the Fe—C—Si—B—P—Nb based alloy.

FIG. 5 is a graph showing the result of a differential thermal analysis of the Fe—C—Si—B—P—Nb—Mo based alloy.

FIG. 6 is a graph showing the result of a differential thermal analysis of the Fe—C—Si—B—P—Ti—Al based alloy.

FIG. 7 is a graph showing the result of a differential thermal analysis of the Fe—C—Si—B—P—Cr—Al based alloy.

BEST MODE FOR CARRYING OUT THE INVENTION

Now, an embodiment of the present invention will be described in detail with reference with the drawing. However, the drawings are only for illustration of a preferred embodiment and the construction and operation of the present invention presented and explained in the drawings is for explanation of an example and the present invention is not limited to the described embodiment.

According to the present invention, the alloy is prepared using cast iron as a base alloy. The cast iron is pig-iron saturated with carbon, which is mass produced in and sold by common iron foundries. Since it contains about 2 atomic % of Si, it can be dissolved in the air and has excellent castability. Also, it has a low melting point to be suitably used as a base metal for preparation a bulk amorphous alloy.

In order to lower a melting temperature and delay crystallization upon cooling, thereby improving glass forming ability, a suitable amount of P(phosphorus) or B(boron) may be added. For this, alloy irons such as Fe—P and Fe—B, used in common cast iron foundries, is used. Various alloy compositions have been examined for their glass forming ability by the trial and error experiment method. Representative examples are shown in Table 1 and FIG. 1 to FIG. 7.

EXAMPLES

Each of the alloy compositions described in Table 1 was prepared by the ark melting method and poured in a copper mold having a diameter of 1 mm and a length of 45 mm to form an amorphous alloy by suction. Then, the resulting specimen was examined for glass transition temperature, crystallization temperature, heat enthalpy upon crystallization and liquidus line temperature. Also, the supercooled liquid region was determined by the glass transition temperature and crystallization temperature and the converted glass transition temperature $T_{rg}=(T_g(K)/T_1(K))$ was determined by the glass transition temperature an the liquidus line temperature.

TABLE 1

| example No. | Composition (atomic %) | Tg (K) | Tx(K) | Δ Tx(K) | Δ H(J/g) | Φ 1 mm |
|---|---|---|---|---|---|---|
| 1 | $Fe_{71.4}C_{12.9}Si_{4.5}B_{8.2}P_{3.0}$ | 814 | 842 | 28 | −65.3 | ○ |
| 2 | $Fe_{70.8}C_{12.9}Si_{4.5}B_{7.7}P_{5.0}$ | 828 | 843 | 15 | −79.2 | ○ |
| 3 | $Fe_{70.5}C_{11.6}Si_{4.5}B_{7.4}P_{6.0}$ | 821 | 845 | 24 | −84.5 | ○ |
| 4 | $Fe_{70.2}C_{11.2}Si_{4.4}B_{7.2}P_{7.0}$ | 828 | 847 | 19 | −86.5 | ○ |
| 5 | $Fe_{69.9}C_{10.5}Si_{4.4}B_{6.9}P_{8.0}$ | 835 | 856 | 21 | −100.9 | ○ |
| 6 | $Fe_{69.6}C_{10.4}Si_{4.4}B_{6.6}P_{9.0}$ | 837 | 855 | 18 | −97.2 | ○ |
| 7 | $Fe_{69.3}C_{10.0}Si_{4.4}B_{6.4}P_{10.0}$ | 837 | 854 | 17 | −99.0 | ○ |
| 8 | $Fe_{69.0}C_{10.9}Si_{3.9}B_{6.4}P_{8.8}Al_{1.0}$ | 814 | 845 | 31 | −64 | ○ |
| 9 | $Fe_{68.4}C_{10.8}Si_{3.9}B_{6.3}P_{8.7}Al_{2.0}$ | 808 | 843 | 35 | −81 | ○ |
| 10 | $Fe_{67.7}C_{10.7}Si_{3.8}B_{6.3}P_{8.6}Al_{2.9}$ | 800 | 834 | 34 | −64 | ○ |
| 11 | $Fe_{69.4}C_{10.8}Si_{3.7}B_{7.0}P_{8.1}Cr_{1.0}$ | 818 | 841 | 23 | −86 | ○ |
| 12 | $Fe_{69.1}C_{10.7}Si_{3.7}B_{7.0}P_{8.0}Cr_{1.5}$ | 22 | 852 | 30 | −94 | ○ |
| 13 | $Fe_{68.9}C_{10.6}Si_{3.6}B_{6.9}P_{7.9}Cr_{2.0}$ | 825 | 854 | 29 | −75 | ○ |
| 14 | $Fe_{68.7}C_{10.5}Si_{3.6}B_{6.8}P_{7.9}Cr_{2.5}$ | 829 | 854 | 25 | −59 | ○ |
| 15 | $Fe_{69.5}C_{10.7}Si_{4.3}B_{6.8}P_{7.8}Nb_{1.0}$ | 824 | 840 | 16 | −67 | Δ |
| 16 | $Fe_{69.3}C_{10.6}Si_{4.3}B_{6.7}P_{7.7}Nb_{1.5}$ | 813 | 838 | 25 | −78 | Δ |
| 17 | $Fe_{69.0}C_{10.5}Si_{4.3}B_{6.6}P_{7.6}Nb_{2.0}$ | 810 | 845 | 35 | −52 | Δ |
| 18 | $Fe_{69.3}C_{10.7}Si_{3.5}B_{6.7}P_{8.9}Mo_{1.0}$ | 817 | 851 | 34 | −66 | ○ |
| 19 | $Fe_{68.6}C_{10.5}Si_{3.5}B_{6.7}P_{8.8}Mo_{1.2}$ | 819 | 855 | 36 | −99 | ○ |
| 20 | $Fe_{69.0}C_{10.9}Si_{4.5}B_{6.8}P_{7.8}Ti_{1.0}$ | 815 | 845 | 30 | −96 | ○ |
| 21 | $Fe_{68.8}C_{10.8}Si_{3.7}B_{6.9}P_{8.8}W_{1.0}$ | 818 | 851 | 38 | −35 | ○ |
| 22 | $Fe_{68.9}C_{11.0}Si_{3.6}B_{6.6}P_{8.9}V_{1.0}$ | 822 | 850 | 28 | −23 | ○ |
| 23 | $Fe_{73.0}C_{6.6}P_{13.3}Sn_{2.9}Mo_{2.4}Si_{1.8}$ | 735 | 755 | 20 | −93 | ○ |
| 24 | $Fe_{69.0}C_{10.4}Si_{3.5}B_{4.9}P_{9.2}Nb_{2.0}Mo_{1.0}$ | 806 | 844 | 38 | −64 | ○ |
| 25 | $Fe_{68.6}C_{10.2}Si_{3.4}B_{4.2}P_{9.1}Nb_{1.9}Mo_{2.0}$ | 805 | 845 | 40 | −64 | Δ |
| 26 | $Fe_{68.3}C_{10.0}Si_{3.4}B_{4.6}P_{8.9}Nb_{1.9}Mo_{3.0}$ | 803 | 841 | 38 | −67 | Δ |
| 27 | $Fe_{69.0}C_{10.4}Si_{3.5}B_{4.9}P_{9.3}Nb_{2.0}W_{1.0}$ | 803 | 837 | 35 | −71 | Δ |
| 28 | $Fe_{68.6}C_{10.2}Si_{3.5}B_{4.8}P_{9.1}Nb_{1.9}W_{2.0}$ | 807 | 841 | 34 | −65 | Δ |
| 29 | $Fe_{68.2}C_{10.0}Si_{3.4}B_{4.7}P_{8.9}Nb_{1.9}W_{3.0}$ | 793 | 828 | 36 | −41 | Δ |
| 30 | $Fe_{68.6}C_{10.5}Si_{3.6}B_{4.9}P_{9.4}Nb_{2.0}Zr_{1.0}$ | 813 | 837 | 24 | −51 | Δ |
| 31 | $Fe_{67.4}C_{10.6}Si_{3.5}B_{6.2}P_{9.3}Ti_{1.0}Cr_{2.0}$ | 824 | 839 | 15 | −76 | ○ |
| 32 | $Fe_{67.0}C_{10.4}Si_{3.5}B_{6.1}P_{9.1}Ti_{1.0}Cr_{2.9}$ | 812 | 837 | 25 | −54 | ○ |
| 33 | $Fe_{66.5}C_{10.2}Si_{3.4}B_{6.0}P_{8.9}Ti_{1.0}Cr_{3.9}$ | 809 | 839 | 30 | −46 | ○ |
| 34 | $Fe_{67.8}C_{10.6}Si_{3.4}B_{6.4}P_{8.8}Mo_{2.0}W_{1.0}$ | 829 | 866 | 37 | −14 | Δ |
| 35 | $Fe_{68.4}C_{10.7}Si_{3.5}B_{6.5}P_{9.0}Ta_{1.0}W_{1.0}$ | 801 | 850 | 49 | −7 | Δ |
| 36 | $Fe_{68.7}C_{10.6}Si_{4.2}B_{6.7}P_{7.8}Ti_{1.0}Al_{1.0}$ | 816 | 847 | 31 | −61 | ○ |
| 37 | $Fe_{68.0}C_{10.5}Si_{4.2}B_{6.7}P_{7.7}Ti_{1.0}Al_{2.0}$ | 812 | 843 | 31 | −61 | ○ |
| 38 | $Fe_{67.3}C_{10.4}Si_{4.1}B_{6.6}P_{7.6}Ti_{1.0}Al_{3.0}$ | 808 | 841 | 33 | −76 | ○ |
| 39 | $Fe_{66.6}C_{10.3}Si_{4.1}B_{6.5}P_{7.5}Ti_{1.0}Al_{4.0}$ | 813 | 843 | 30 | −58 | ○ |
| 40 | $Fe_{65.4}C_{10.2}Si_{3.0}B_{5.8}P_{9.0}Cr_{5.0}Al_{1.7}$ | 819 | 859 | 40 | −101 | ○ |
| 41 | $Fe_{64.8}C_{10.0}Si_{2.9}B_{5.8}P_{8.9}Cr_{6.0}Al_{1.6}$ | 812 | 862 | 50 | −92 | ○ |
| 42 | $Fe_{65.8}C_{10.2}Si_{3.3}B_{6.2}P_{5.6}Cr_{2.1}Mo_{1.9}Al_{2.0}$ | 735 | 755 | 20 | −93 | ○ |

In order to further improve the glass forming ability of the Fe—C—Si—P—B alloy prepared by adding Fe—P and Fe—B to cast iron, a suitable amount of various alloy irons was added thereto, in which the alloy elements combinedly and simultaneously participate in the improvement of the amorphousness. For example, Sn (stannum) and Al (aluminum) lowered the melting point of the alloy to improve the glass forming ability and densify the atomic structure in the liquid phase, thereby preventing immigration of atoms. As a result, the crystallization rate was deteriorated and thus the glass forming ability was improved.

Meanwhile, Ti(titanium), Mo(molybdenum), Cr(chromium) and W(tungsten), NB (niobium), though might raise the melting point of the liquid phase, mostly densified the atomic structure of the liquid phase and lowered the diffusion rate of the elements and thereby, the crystallization rate, since they formed strong bonds with the elements participating in the crystallization such as C(carbon) or Si(silicon). As a result, they contributed to improvement of glass forming ability. However, the effects of these elements are greatly varied by relative proportions of the respective elements and the optimal element composition having excellent glass forming ability was determined by the trial and error experimental method since it could not be determined theoretically.

The amorphous alloy according to the present invention can be prepared by the rapid quenching method, the mold casting method, the die casting method and the like and the amorphous alloy powder can be prepared by the atomizing method.

Since the amorphous alloy according to the present invention can have a wide supercooled liquid region of 20K to 50K, it has excellent processability at a low temperature and can produce amorphous part materials by forging rolling, drawing and other processes. The amorphous alloy according to the present invention can produce a having the amorphous phase and the crystalline phase by the teat treatment and also can produce a based on the amorphous phase according to the present invention by addition of second phase powder of nm unit or μm unit, followed by extrusion and rolling.

As described above, since the alloy composition according to the present invention has excellent castability, it is possible to prepare part materials having complicated shapes by various casting processes. Also, since the alloy composition according to the present invention can have a wide supercooled liquid region and thereby, excellent processability, it is possible to readily form parts with a special shape by the viscous fluidity in the supercooled liquid region after preparing a bulk amorphous alloy in a plate shape, a road shape or other shapes.

Further, according to the present invention, it is possible to form a bulk amorphous parts while maintaining the amorphous structure by preparing amorphous powder by the atomizing method and then applying high pressure at a high temperature on a preformed body of powder in the supercooled liquid region.

Although a few embodiment of the present invention have been shown and described, the present invention is not limited to the described embodiments. Instead it would be appreciated by those skilled in the art that changes may be made to these embodiments without departing from the principles and spirit of the invention, the scope of which is defined by the claims and their equivalents.

INDUSTRIAL APPLICABILITY

By the above-described characteristics of the present invention, the following effects can be obtained.

Firstly, the Fe-based multi-element bulk amorphous alloy composition according to the present invention has excellent glass forming ability which can produce the amorphous phase at a low critical cooling rate upon cooling.

Secondary, it is possible to readily produce bulk amorphous materials in a plate shape, a rod shape or other shapes or powder amorphous materials by the casting method and powder metallurgic method.

Thirdly, when the material according to the present invention is heated, there is observed a very wide supercooled liquid region of 20 to 50 K over the glass transition temperature and by using the excellent viscous fluidity of the supercooled liquid phase, it is possible to readily and economically form an amorphous material with a certain shape or nano structure parts.

Fourthly, by using the comprising the amorphous phase, it is possible to prepare part materials having excellent properties combining properties of the crystalline phase and the amorphous phase.

The invention claimed is:

1. A Fe-based multi-element bulk amorphous alloy composition represented by a formula of $Fe_aC_\beta Si_\gamma B_x P_y M_a$, in which α, β, γ, x, y, and a each represent atomic % of iron(Fe), Carbon(C), silicon(Si), boron(B), phosphorus(P) and a selected metal element respectively, in which α is 100-(β+γ+x+y+a) atomic %, where M is the selected metal element which is Ti, β is 9 atomic % or more and 11 atomic % or less, γ is 4 atomic % or more and 5 atomic % or less, x is 6 atomic % or more and 7 atomic % or less, y is 7 atomic % or more and 9 atomic % or less and a is 0.5 atomic % or more and 1.5 atomic % or less.

2. A Fe-based multi-element bulk amorphous alloy composition represented by a formula of $Fe_a C_\beta Si_\gamma B_x P_y M_a$, in which α, β, γ, x, y, and a each represent atomic % of iron(Fe), Carbon(C), silicon(Si), boron(B), phosphorus(P) and a selected metal element respectively, in which α is 100-(β+γ+x+y+a) atomic %, where M is the selected metal element which is W or V, β is 9 atomic % or more and 11 atomic % or less, γ is 3 atomic % or more and 5 atomic % or less, x is 6 atomic % or more and 7 atomic % or less, y is 7 atomic % or more and 9 atomic % or less and a is 0.5 atomic % or more and 1.5 atomic % or less.

3. A Fe-based multi-element bulk amorphous alloy composition represented by a formula of $Fe_a C_\beta Si_\gamma B_x P_y M_a$, in which α, β, γ, x, y, and a each represent atomic % of iron(Fe), Carbon(C), silicon(Si), boron(B), phosphorus(P) and a combination of selected metal elements respectively, in which α is 100-(β+γ+x+y+a) atomic %, where M is the combination of selected metal elements which is Nb+Mo, β is 9 atomic % or more and 11 atomic % or less, γ is 4 atomic % or more and 5 atomic % or less, x is 6 atomic % or more and 7 atomic % or less, y is 7 atomic % or more and 9 atomic % or less and a is 0.5 atomic % or more and 1.5 atomic % or less.

4. A Fe-based multi-element bulk amorphous alloy composition represented by a formula of $Fe_a C_\beta Si_\gamma B_x P_y M_a$, in which α, β, γ, x, y, and a each represent atomic % of iron(Fe), Carbon(C), silicon(Si), boron(B), phosphorus(P) and a combination of selected metal elements respectively, in which α is 100-(β+γ+x+y+a) atomic %, where M is the combination of selected metal elements which is Ti+Cr, β is 9 atomic % or more and 11 atomic % or less, γ is 4 atomic % or more and 5 atomic % or less, x is 6 atomic % or more and 7 atomic % or less, y is 7 atomic % or more and 9 atomic % or less and a is 0.5 atomic % or more and 1.5 atomic % or less.

5. An Fe-based multi-element bulk amorphous alloy composition represented by a formula of $Fe_a C_\beta Si_\gamma Sn_x P_y Mo_a$, in which α, β, γ, x, y and a each represent atomic % of iron(Fe), Carbon(C), silicon(Si), tin(Sn), phosphorus(P) and molybdenum(Mo), in which α is 100-(β+γ+x+y+a) atomic %, β is 6 atomic % or more and 7 atomic % or less, γ is 1.5 atomic % or more and 2.5 atomic % or less, x is 2.5 atomic % or more and 3.5 atomic % or less, y is 13 atomic % or more and 14 atomic % or less and a is 2 atomic % or more and 3 atomic % or less.

* * * * *